US005655998A

United States Patent [19]

Yu

[11] Patent Number: 5,655,998

[45] Date of Patent: Aug. 12, 1997

[54] SPACE WALKING EXERCISER

[76] Inventor: Chih-An Yu, P.O. Box 82-144, Taipei, Taiwan

[21] Appl. No.: 758,579

[22] Filed: Dec. 3, 1996

[51] Int. Cl.[6] ..... A63B 22/00

[52] U.S. Cl. ..... 482/51; 482/908

[58] Field of Search ..... 482/51, 52, 53, 482/70, 71, 148, 908, 79, 80, 74, 143, 144; 434/255

[56] References Cited

U.S. PATENT DOCUMENTS

| | | | |
|---|---|---|---|
| 4,531,731 | 7/1985 | Law | 482/144 |
| 5,419,747 | 5/1995 | Piaget et al. | 482/51 |
| 5,496,235 | 3/1996 | Stevens | 482/52 |
| 5,584,780 | 12/1996 | Lin | 482/52 |
| 5,584,781 | 12/1996 | Chen | 482/51 |
| 5,599,257 | 2/1997 | Lee | 482/51 |
| 5,603,675 | 2/1997 | Wu | 482/51 |

*Primary Examiner*—Stephen R. Crow
*Attorney, Agent, or Firm*—Alfred Lei

[57] ABSTRACT

A space walking exerciser including two swinging frames hung on a stand and equipped with a respective foot plate, two damping devices adapted for imparting a damping resistance to the swinging frames, and two swinging angle control devices bilaterally fixed to the stand and respectively coupled to the damping devices to limit the swinging angle of the swinging frames, each swinging angle control device including a sector plate fixed to the stand and having two stop plates and a smoothly arched bearing plate between the stop plates, a guide rod fixed to one swinging frame, and a roller mounted around the guide rod and moved with the corresponding swinging frame along the bearing plate between the stop flanges of the corresponding sector plate.

1 Claim, 7 Drawing Sheets

SPACE WALKING EXERCISER

BACKGROUND OF THE INVENTION

1. Field of the Invention

This invention relates to space walking exercisers, and more particularly to such a space walking exerciser which has means to limit the swinging angle of the swinging frames thereof to a fixed range.

2. Description of the Prior Art

FIGS. 6 and 7 show the operation of a prior art space walking exerciser. This space walking exerciser comprises a stand 1, two swinging frames 11 hung on the stand 1 and having a respective foot plate 12 at the bottom, and a transverse handle 13 mounted on the stand 1 at the top. This structure of space walking exerciser is dangerous in use. Because the swinging frames 11 are hung on the stand 1 and turned about an axis freely, they tend to be forced to swing over a broad swinging angle. When pushing the foot plates of the swinging frames alternatively, the legs may be opened excessively, causing the muscles of the legs to be injured (see FIG. 6). When pushing the foot plates of the swinging frames synchronously in the same direction, the center of gravity of operator may be shifted upwards suddenly, causing the operator to fall from the space walking exerciser (see FIG. 7).

SUMMARY OF THE INVENTION

This invention relates to space walking exercisers, and more particularly to such a space walking exerciser which has means to limit the swinging angle of the swinging frames thereof to a fixed range.

According to the present invention, the space walking exerciser is equipped with two swinging angle control devices, which limit the swinging angles of the swinging frames respectively. Each swinging angle control device comprises a sector plate fixed to the stand and having two stop plates and a smoothly arched bearing plate between the stop plates, a guide rod fixed to one swinging frame, and a roller mounted around the guide rod and moved with the corresponding swinging frame along the bearing plate between the stop flanges of the corresponding sector plate.

DETAILED DESCRIPTION OF THE PREFERRED EMBODIMENT

Figure 1:
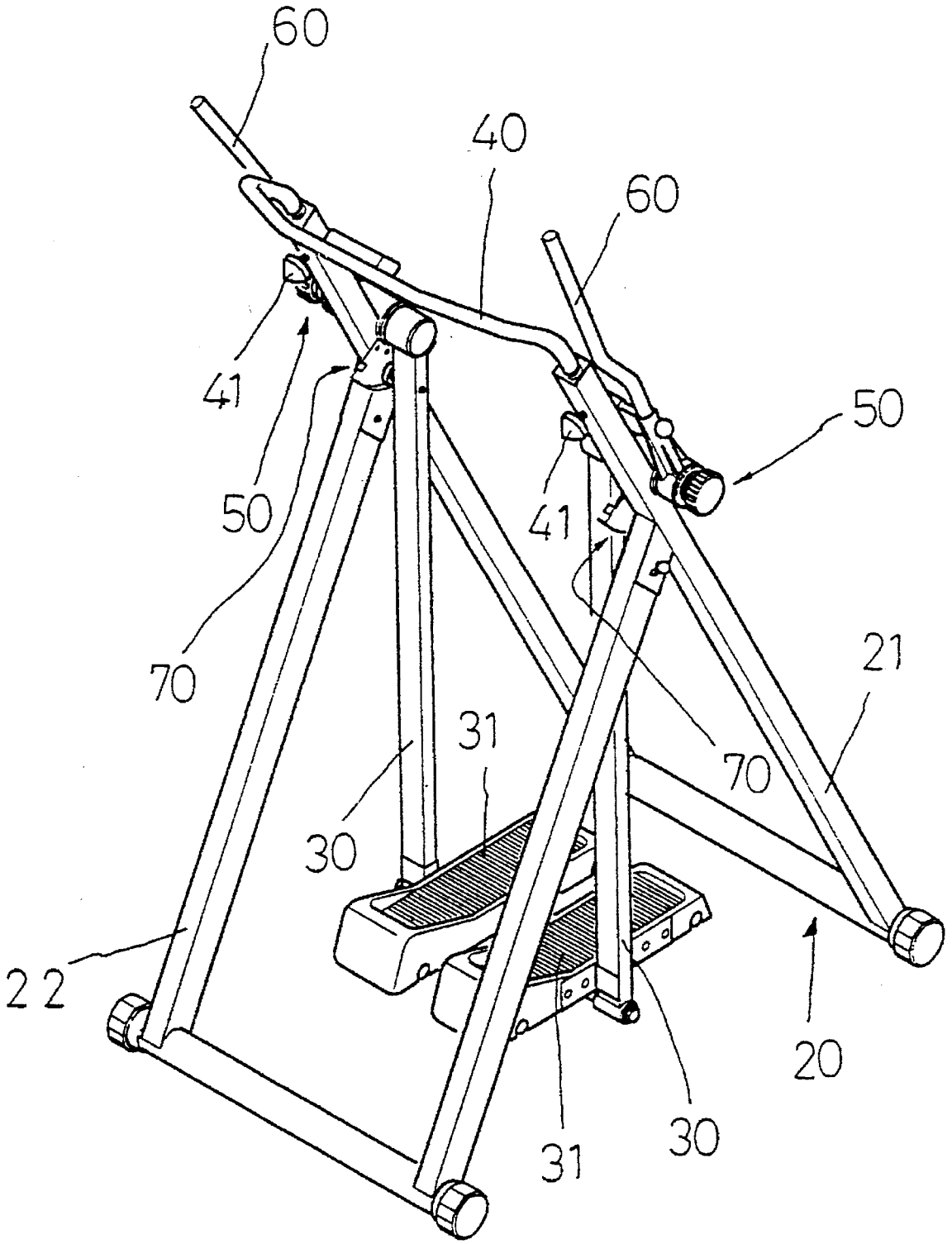
FIG. 1 is an elevational view of a space walking exerciser according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
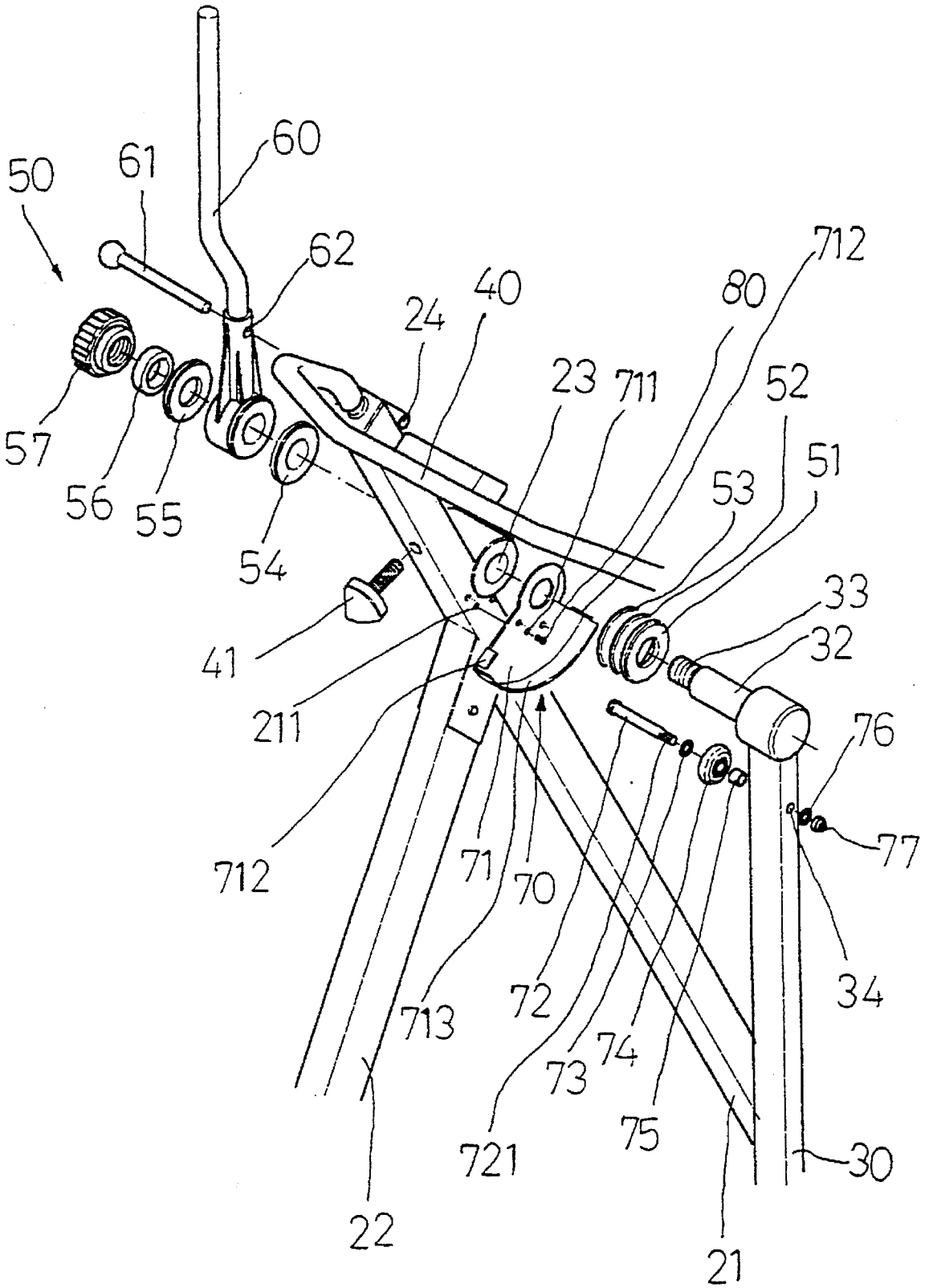
FIG. 2 is an exploded view of a part of the space walking exerciser shown in FIG. 1.

Referring to FIGS. 1 and 2, a space walking exerciser in accordance with the present invention comprises a stand 20, two swinging frames 30, a handle 40, two damping devices 50, two eye-end levels 60, and two swinging angle control devices 70. The stand 20 is comprised of a substantially U-shaped front stand frame 21 and a substantially U-shaped rear stand frame 22 fastened together, and can be stably supported on the ground. Two transverse barrels 23 and two transverse sleeves 24 are welded to the two opposite ends of the front stand frame 21 at the front side at different elevations. The swinging frames 30 have a respective bottom end fixedly mounted with a respective foot plate 31. The handle 40 has two opposite ends respectively fastened to the two opposite ends of the front stand frame 21 by a respective screw 41. The damping devices 50 are bilaterally mounted on the front stand frame 21 at the front side. The swinging angle control devices 70 are respectively connected between the two opposite ends of the front stand frame 21 and the two swinging frames 30.

Figure 3:
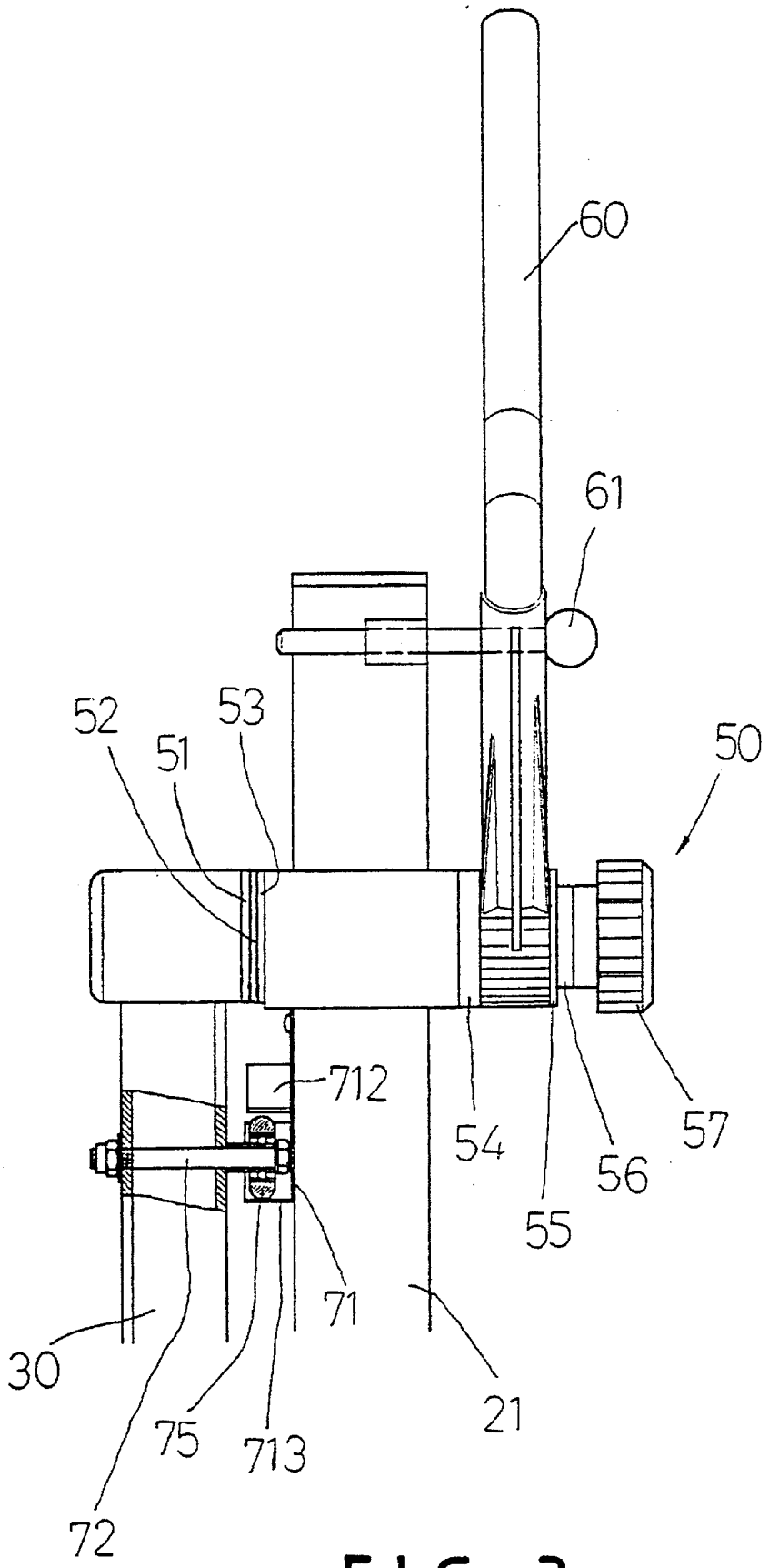
FIG. 3 is an enlarged view of a part of the present invention, showing the relationship between the swinging angle control device and the swinging frame.
Figure 5:
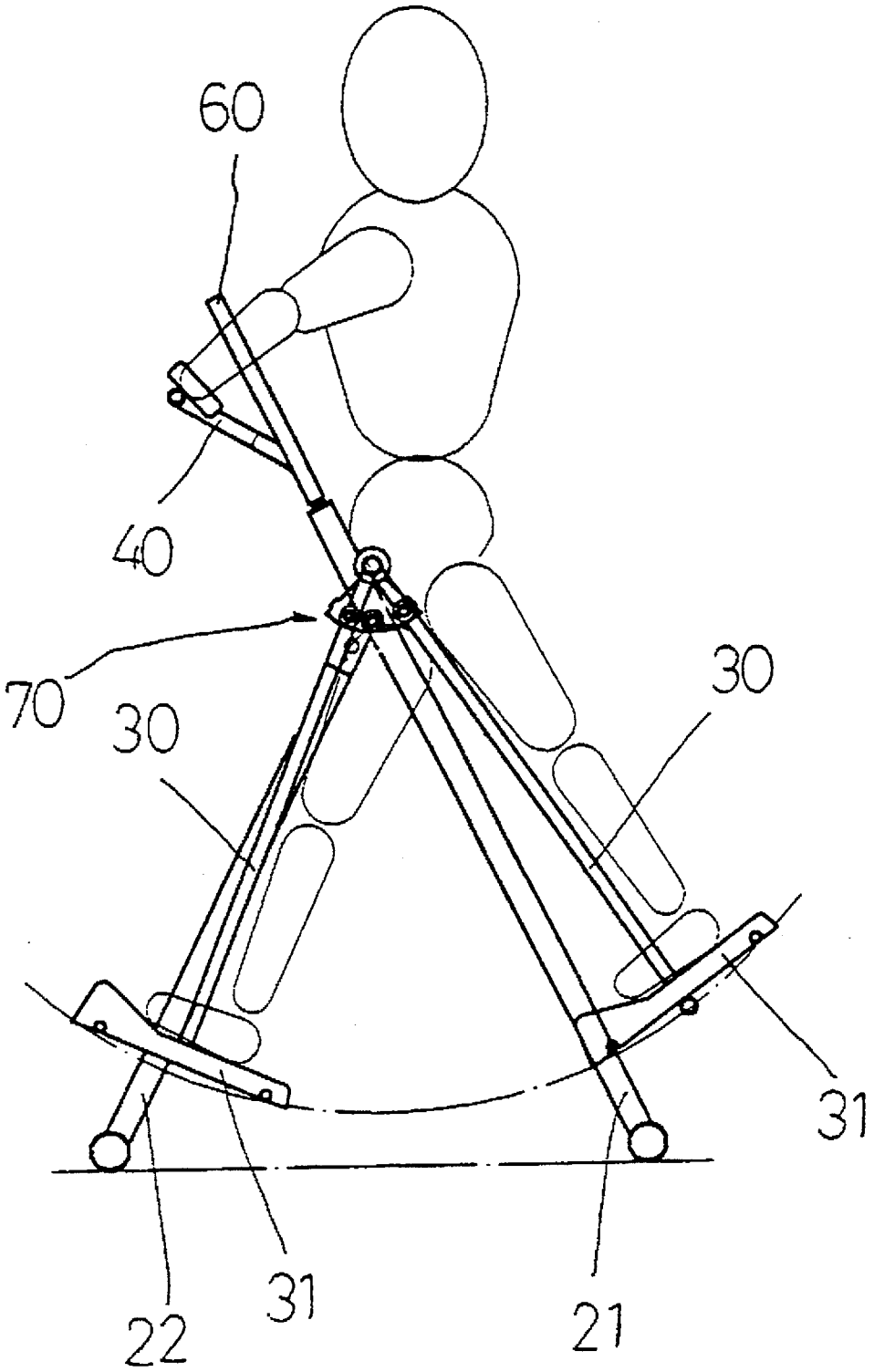
FIG. 5 is a side view of the present invention, showing the swinging angle of the swinging frames.
Figure 6:
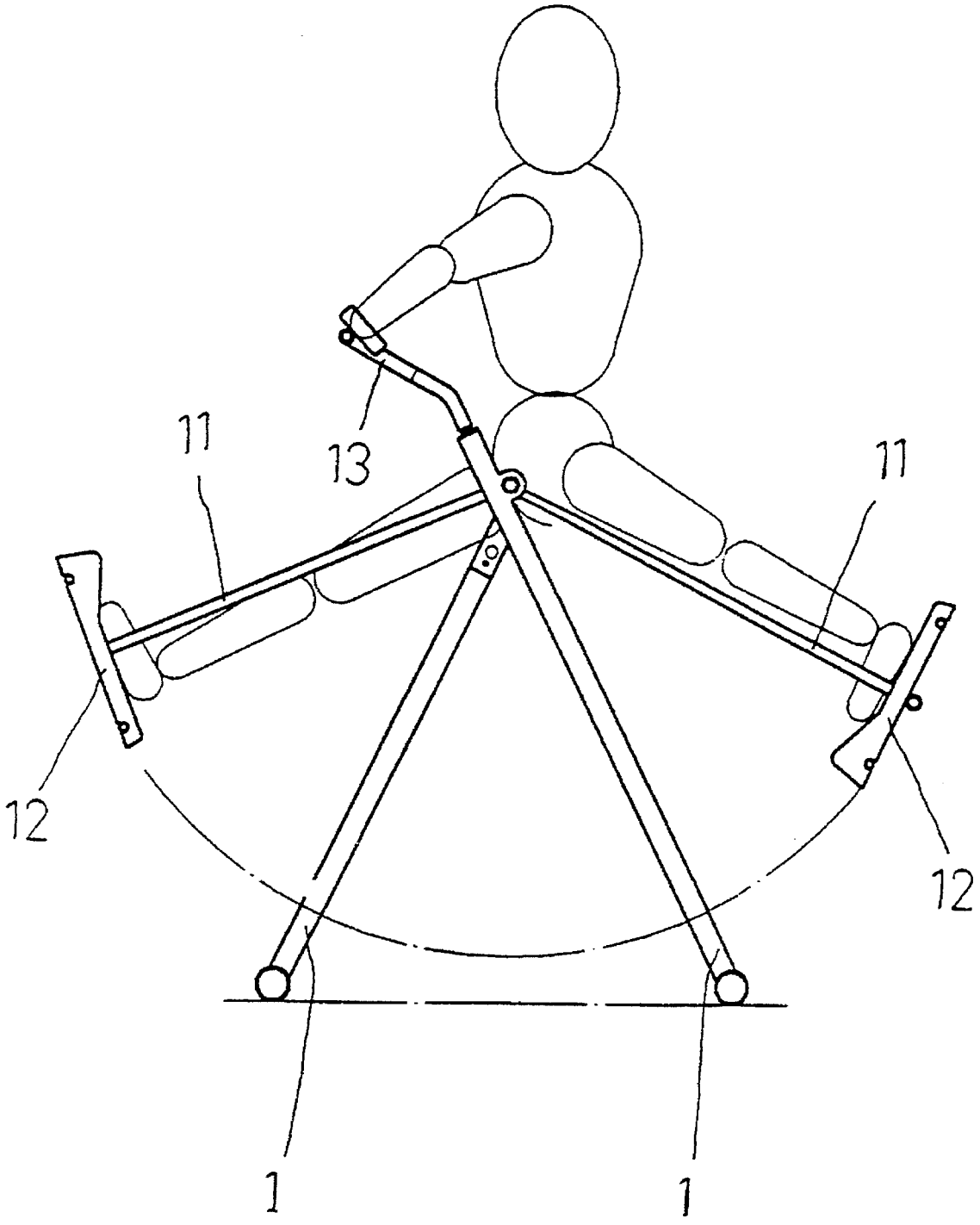
PRIOR ART FIG. 6
FIG. 6 is a plain view showing one dangerous operation condition of a space walking exerciser according to the prior art.
Figure 7:
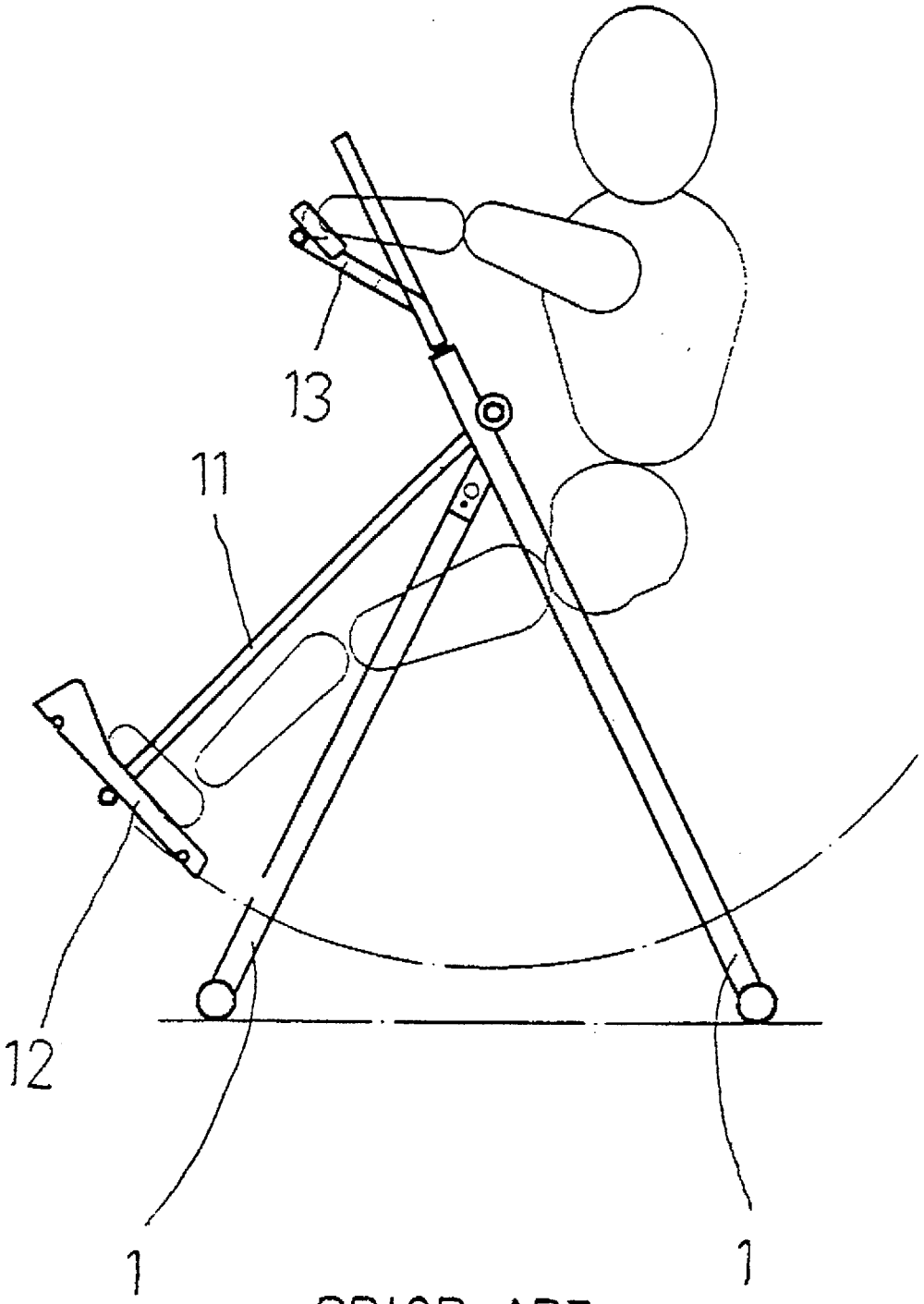
PRIOR ART FIG. 7
FIG. 7 is another plain view of the prior art space walking exerciser, showing another dangerous operation condition.

Referring to FIG. 2 again, each swinging frame 30 comprises a transverse top coupling rod 32, and a screw rod 33 extended from the top coupling rod 32. Each damping device 50 comprises a brake lining ring 51, a plurality of cushion rings 52, 53 and 54, a bushing 56, and a screw nut 57. The top coupling rod 32 is inserted in proper order through the brake lining ring 51, the cushion rings 52, 53, one transverse barrel 23 of the front stand frame 21, the cushion 54, the corresponding eye-end lever 60, the cushion 55 and the bushing 56, and then screwed up with the screw nut 57. By turning the screw nut 57 inwards or outwards, the friction resistance between the brake lining ring 51 and the corresponding swinging frame 30 is adjusted. The eye-end lever 60 is pivoted to one damping device 50, having a transverse through hole 62 spaced from the corresponding damping device 50 and connected to one transverse sleeve 24 of the front stand frame 21 by a pin 61. Referring to FIGS. 5 and 6, and FIG. 4 again, each swinging angle control device 70 comprises a sector plate 71, a guide rod 72 having one end terminating in a screw rod 721, a first cushion ring 73, a roller 74, a bushing 75, a second cushion ring 76, and a screw nut 77. The sector plate 71 is hung on the transverse top coupling rod 32 of one swinging frame 30 between the cushion ring 53 of the respective damping device 50 and the corresponding transverse barrel 23 of the front stand frame 21, having mounting holes 711 respectively fixed to respective screw holes 211 in one end of the front stand frame 21 by screws 80, two stop flanges 712 perpendicularly raised from two lateral sides, and a smoothly arched bearing plate 713 perpendicularly raised from the periphery between the stop flanges 712. The guide rod 72 is inserted in proper order through the first cushion ring 73, the roller 74, the bushing 75, a transverse through hole 34 in the corresponding swinging frame 30, and the second cushion 76, and then screwed up with the screw nut 77. When the swinging angle control device 70 is installed, the roller 74 is moved with the corresponding swinging frame 30 along the smoothly arched bearing plate 713 of the sector plate 71 between the two stop flanges 712 (see FIGS. 3 and 4).

Figure 4:
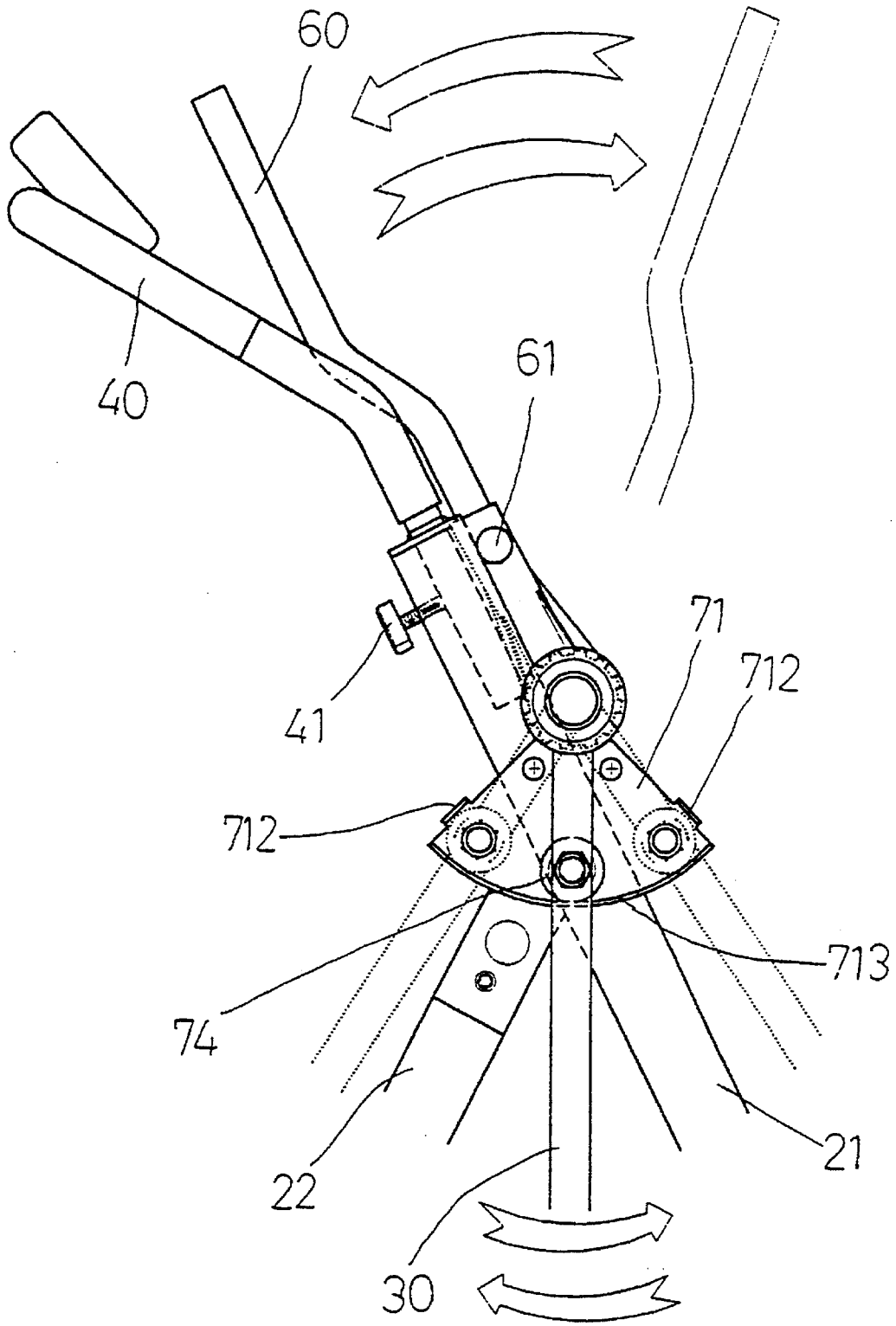
FIG. 4 is a schematic drawing showing the swinging frame oscillated relative to the swinging angle control device according to the present invention.

Referring to FIG. 4 and FIG. 5 again, when use, the user's legs are placed on the foot plates 31 of the swinging frames 30 with the hands holding on the handle 40, thus the user can then push the legs to swing the swinging frames 30. When the swinging frames 30 are moved back and forth, the rollers 74 of the swinging angle control devices 70 are respectively moved along the smoothly arched bearing plates 713 of the respective sector plates 71 between the respective stop flanges 712. Furthermore, when the pins 61 are respectively removed from the eye-end levers 60 and the sleeves 24 of the front stand frames 21 of the stand 20, the eye-end levers 60 can then be held with the hands and moved to swing the swinging frames 30.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A space walking exerciser comprising:

a stand, said stand comprising a front stand frame and a rear stand frame fastened together;

two swinging frames bilaterally hung on the front stand frame of said stand and turned about an axis, each of said swinging frames having a foot plate at a bottom end;

two damping devices bilaterally mounted on said front stand frame to impart a damping resistance to said swinging frames respectively;

and two swinging angle control devices bilaterally mounted on the front stand frame of said stand to limit the swinging angle of said swinging frames;

wherein each of said swinging angle control devices comprises:

a sector plate fixedly fastened to the front stand frame of said stand and coupled to one damping device and hung on a part of one swinging frame, said sector plate comprising two stop flanges perpendicularly raised from two lateral sides, and a smoothly arched bearing plate perpendicularly raised from the periphery between said stop flanges;

a guide rod having one end terminating in a screw rod inserted through a hole in one swinging frame and screwed up with a screw nut;

cushion means mounted around said guide rod at two opposite sides of the corresponding swinging frame; and roller means mounted around said guide rod and moved with the corresponding swinging frame along the smoothly arched bearing plate between the two stop flanges of the corresponding sector plate, to limit the swinging angle of the corresponding swinging frame.

* * * * *